US005791308A

United States Patent [19]

Carter et al.

[11] Patent Number: 5,791,308

[45] Date of Patent: Aug. 11, 1998

[54] PLUG ASSEMBLY

[75] Inventors: Robert Nash Carter; Gregory Scott Jackson, both of New Haven; William C. Pfefferle, Madison, all of Conn.

[73] Assignee: Precision Combustion, Inc., New Haven, Conn.

[21] Appl. No.: 897,016

[22] Filed: Jul. 18, 1997

[51] Int. Cl.[6] ..... F23Q 7/22

[52] U.S. Cl. ..... 123/145 A; 219/270; 361/264

[58] Field of Search ..... 123/145 A, 145 R; 219/260, 267, 270, 205; 361/247, 264, 266

[56] References Cited

U.S. PATENT DOCUMENTS

| | | | |
|---|---|---|---|
| 4,426,568 | 1/1984 | Kato et al. | 219/270 |
| 4,437,440 | 3/1984 | Suzuki et al. | 123/145 A |
| 4,896,636 | 1/1990 | Pfefferle | 123/145 A |
| 5,580,476 | 12/1996 | Dam et al. | 219/270 |
| 5,593,607 | 1/1997 | Dam et al. | 219/270 |

*Primary Examiner*—Tony M. Argenbright
*Assistant Examiner*—Hieu T. Vo
*Attorney, Agent, or Firm*—Kane, Dalsimer, Sullivan, Kurucz, Levy, Eisele and Richard

[57] ABSTRACT

A plug assembly for ignition of fuel in admixture with air within a combustion chamber which comprises an exposed heating element having a multi-turn coil of electrically conductive catalytic wire mounted in grooves formed on the surface of ceramic support structure.

26 Claims, 2 Drawing Sheets

PLUG ASSEMBLY

This invention was made with government support under DAAE 07-92-C-R041 awarded by the United States Army. The U.S. government has certain rights in this invention.

BACKGROUND OF THE INVENTION

1. Field of the Invention

The invention relates to an assembly for ignition of combustion in combustion chambers.

2. Brief Description of Related Art

Glow plugs of various designs, exposed heater and enclosed heater, are used for ignition in a wide variety of combustion systems. For example, in diesel engines glow plugs serve to enable cold start ignition. Glow plugs can also be used in diesel engines to provide a continuous ignition source to support reduced emissions or to enable combustion of low cetane fuels, such as natural gas or methanol. Where a glow plug is employed as a continuous ignition source, it also provides the cold start ignition.

For a glow plug to support cold start ignition at very low temperatures, ie below about 250 degrees Kelvin, or continuous ignition of low cetane fuels, significantly higher plug temperatures are required, thus a wider operating temperature range than available with conventional glow plugs. Moreover, a continuous ignition glow plug requires greater durability than a conventional cold start ignition glow plug. Continuous operation exposes the heating element of the glow plug to many more hours of operation, while the significantly higher igniter temperatures required for extreme cold starting or use with low cetane fuels, such as methanol, ethanol and other alcohols as well as gasoline and natural gas, also impacts durability. Thus, if a low cetane fuel is being used in the engine, durability is impacted by both the increased plug temperature and the increase in operating hours required for continuous ignition. As a result, there is a need for glow plugs which are durable and effective at higher temperatures than state of the art glow plugs.

Conventional exposed heater element glow plugs designed to withstand the combustion environment have a relatively short, heavy gauge wire heating element, typically one or two turns. Therefore, the electrical resistance is low and the voltage is limited to one to two volts. Such plugs are neither durable nor compact enough and thus have largely been displaced as igniter plugs in diesels by enclosed heater (sheathed) glow plugs. Thus, exposed heater glow plugs have not been considered good candidates for continuous duty glow plugs by those skilled in the art.

Consequently, enclosed heater style glow plugs, similar to those found in U.S. Pat. Nos. 4,896,636, 5,580,476 and 5,593,607, have been relied upon for this dual purpose mission. Such plugs not only avoid exposure of the heater element to the combustion environment but allow use of a heater consisting of a fairly high number of coils of fairly fine wire and thus can operate on a higher voltage. The enclosed heater style glow plug relies on heat conduction from the center heater to heat the external surface to provide sufficient heat to support continuous ignition or cold starting. This design, however, has two significant short comings. First, durability of the glow plug is a function of durability of the surface encasing the enclosed heating element; failure of the surface around the heating element leads to failure of the heater element. Second, the heater must always be operated at a temperature above the temperature required to support ignition or cold starting, since the heat must be transmitted from the heater to the surface of the protective surface encasing the heating element. The requirement for increased operating temperature of the heating element places additional stress on the heater element with direct durability consequences in continuous ignition applications. Use of low cetane fuels only serves to worsen the problem. Those skilled in the art of glow plug design have realized that this latter problem can be ameliorated by using a catalyst, as in the above noted patents. The use of a catalyst, coated on the surface or wrapped around the surface of the tip of the glow plug, reduces the temperature required of the glow plug to support continuous ignition, thereby allowing the heating element to operate at a lower temperature for any given fuel cetane level. For a given temperature, this yields the benefit that the glow plug can now support the use of lower cetane fuels than otherwise. The internally heated glow plug, however, is still temperature limited by the internal heater, the encasing surface durability, and the heat that the heater can dependably and durably impart to the surface. Therefore, in those operating conditions where a high heating level is required, such as extreme cold starting or continuous ignition operation, sheathed glow plugs suffer sever durability consequences. Plug life is much too short.

Thus there is a need for durable, continuous operation glow plugs that can survive at the higher temperatures needed to support the broad-spectrum, continuous ignition of lower cetane fuels under adverse operating conditions. The present invention meets this objective by combining the best attributes of enclosed heater glow plugs and exposed heater glow plugs into a unique exposed heater design which allows the benefits of catalytically supported combustion. The present invention provides igniters which combine catalytic activity and the resulting ability to operate at lower temperatures with the capability to operate at high temperatures in a combustion environment.

SUMMARY OF THE INVENTION

It has now been found that igniters durable at temperatures much higher than conventional combustion chamber glow plugs can be fabricated by winding high melting point, oxidation resistant wire onto a heat sink mandrel of a refractory oxide material, such as alumina or similar ceramic material, and providing electrical leads to allow direct electrical heating of the wire. Coils of at least four or more turns are preferred for igniters of the present invention. Using the preferred embodiment igniter of the present invention, atomized fuel entering a combustion chamber is reliably ignited as it contacts a hot catalytic wire coil of oxide hardened platinum alloy that has been electrically heated by passage of an electric current. Thermal contact, radiation and conduction, from the wire to the mandrel moderates the effect of high combustion temperatures on the temperature of the catalyst element. The term "thermal contact" as used herein means providing effective heat transfer. Use of a high temperature oxidation resistant catalytic metal, such as an oxide dispersion hardened platinum group metal for the coil wire not only provides catalytic enhancement of ignition but allows for operation even with temperature excursions over 1700 degrees Kelvin, thus providing a wide margin between the coil temperature required for reliable ignition under adverse operating conditions and the maximum safe plug temperature. Even under adverse ignition conditions, the maximum required coil temperature for ignition is no more than about 1400 degrees Kelvin. Platinum group metals include platinum, palladium, iridium, and rhodium as well as alloys thereof.

DETAILED DESCRIPTION OF THE PREFERRED EMBODIMENTS OF THE INVENTION

Those skilled in the art will gain an appreciation of the invention from reading the following description of preferred embodiments of the invention in conjunction with viewing of the accompanying drawings.

Figure 1:
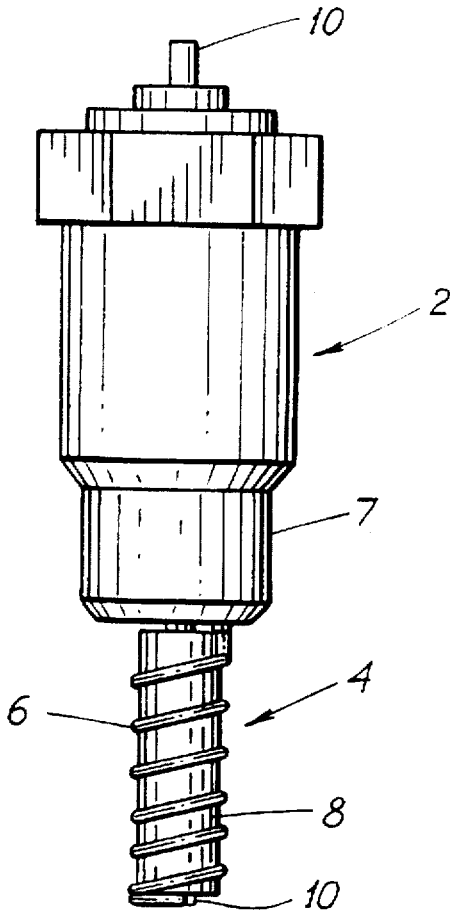
FIG. 1 shows a side view of an igniter plug of the present invention using the body of the igniter plug as the second electrode.

As shown in FIG. 1, igniter plug 2 comprises an igniter element 4 having an electrically resistive heating element coil of catalytic wire 6 wound on mandrel 8 and connected at one end to electrode 10 and the other end to body 7 which is designed to allow installation of the igniter plug into a combustion zone, such as a diesel engine cylinder. Electrode 10 passes through both mandrel 8 and the body 7 and is electrically insulated from body 7.

Figure 2:
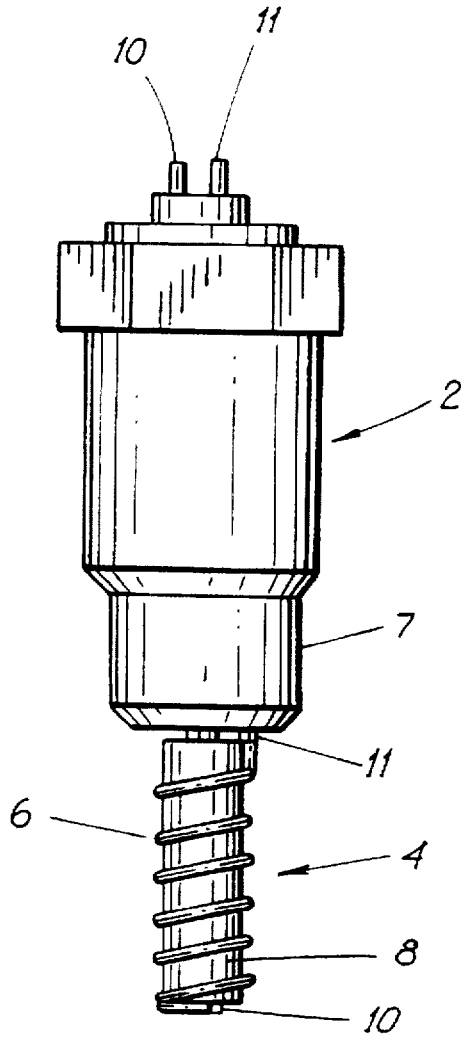
FIG. 2 shows a side view of an igniter plug of the present invention using a second electrode within the body of the igniter plug.

As shown in FIG. 2, igniter plug 2 comprises an igniter element 4 having an electrically resistive heating element coil of catalytic wire 6 wound on mandrel 8 and connected at one end to electrode 10 and the other end is connected to electrode 11 and a body 7 which is designed to allow installation of the igniter plug into a combustion zone, such as a diesel cylinder. Electrodes 10 passes through both mandrel 8 and the body 7 and is electrically insulated from body 7. Electrode 11 also passes through body 7 and is electrically insulated from both body 7 and electrode 10.

It is important that electrode 10 be selected such that when the igniter plug wire 6 is operating at its desired operating temperature the operating temperature of electrode 10 will be less than the operating temperature of wire 6. The specific temperature difference is based on the design considerations for a particular application. The major elements that a person skilled in the art should consider when selecting the material for and size of electrode 10 are: the temperature at which the electrode material will fail, the temperature delta between the ultimate temperature inside of the mandrel that will be generated by the heat of the electrode versus the wire temperature to assure that center mandrel temperature will be less than the wire temperature, and that less thermal stress on the electrode will increase the service life of the igniter element. The primary design parameter to be used in designing the electrode is electrical resistance. Electrode 10 must have an electrical resistance significantly less than that of wire 6, as must electrode 11.

Figure 3:
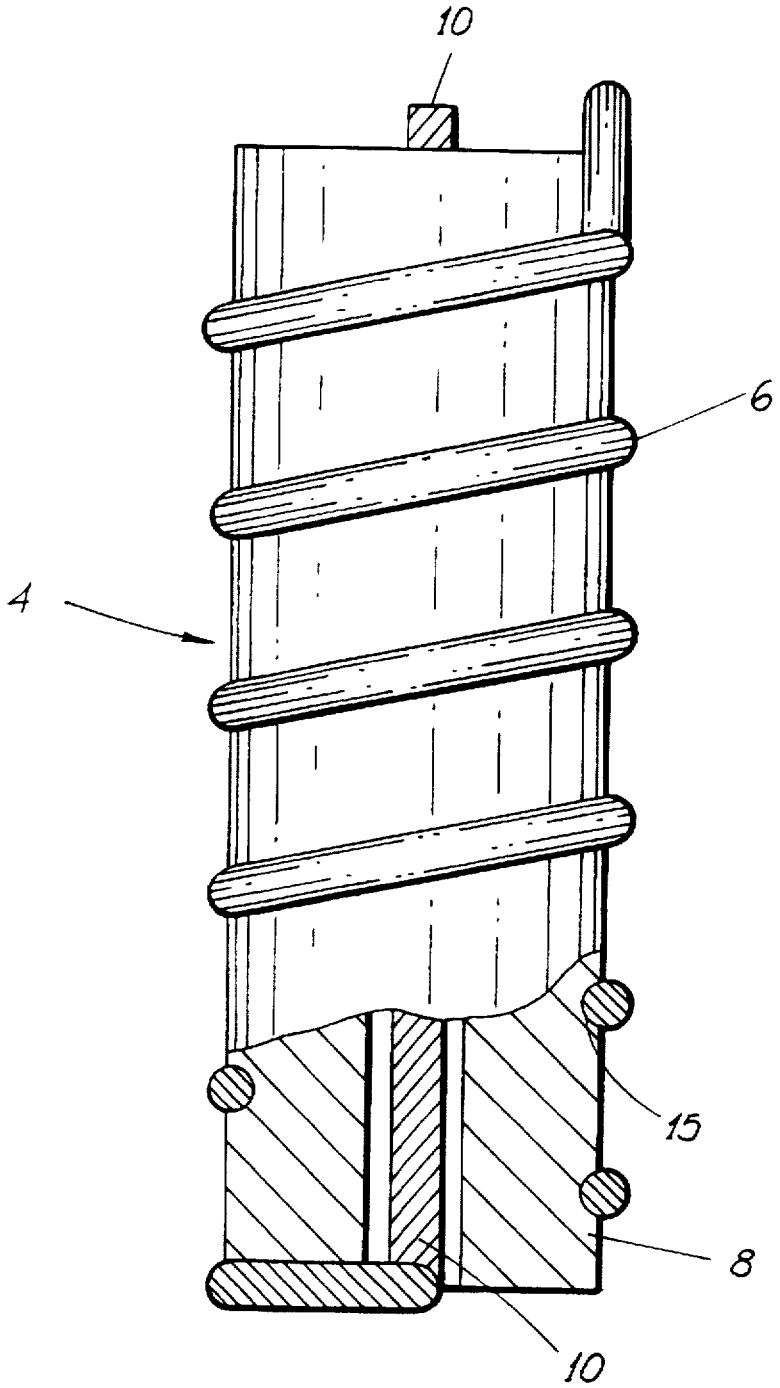
FIG. 3 shows a partial cross-sectional side view of an embodiment of an igniter element of the invention having an electrical heater/catalyst wire wound on an alpha alumina heat sink mandrel.

With reference to FIG. 3, a partial sectional view of an embodiment assembly of the invention as seen from the side, igniter element 4 comprises heat sink mandrel 8 having spiral grooves 15 holding a multi-turn coil of catalytic wire 6. Advantageously, the grooves have a depth of at least about 25 percent of the wire 6 diameter. In preferred embodiments of the invention, the catalytic resistance heating element utilizes an alloy wire preferably having a service temperature in air of at least about 1400 degrees Kelvin, and more preferably 1500 degrees Kelvin, such as an alloy of oxide dispersion hardened platinum metal, which serves as both the catalyst and the electrically resistive heater. The term "service temperature" as used herein is a temperature at which the wire can survive for at least fifty hours. The use of a platinum metal alloy, having a stable electrical resistivity temperature relationship, provides the advantage of allowing feedback control of the element temperature as well as providing a renewable catalyst surface in erosive environments. In addition, since electrical resistance increases with increase in temperature, a platinum wire coil is self regulating in that with a fixed applied voltage the electrical current decreases with increase in wire temperature. This means that plugs can be connected to a fixed voltage supply without use of a temperature controller. A platinum group metal clad tungsten wire offers similar advantages. Less advantageously the catalytic heating coils may also be formed from other oxidation resistant alloys as for example, from Haynes 214 or Fecralloy wire, such as Allegheny Ludlum's Alpha-IV, coated with an ignition catalyst known in the art, such as a platinum metal catalyst.

In the embodiment shown, wire 6, made from oxide hardened platinum, is wound on mandrel 8 which is a ceramic alumina support. Other ceramic materials of high electrical resistivity to prevent short circuiting between coils and good thermal conductivity are also suitable for heat sink mandrel 8. For long-life and durability, the wire 6 is thus itself a catalyst metal that not only offers the advantages of catalytic reactivity, allowing ignition temperatures below 1400 degrees Kelvin, but provides the capability of reliably operating long term at temperatures as high as 1600 degrees Kelvin, which is a temperature well above that required for ignition of even fuels such as methane or methanol. If desired, the temperature of the element may be most readily monitored and controlled by measurement of element electrical resistance.

EXAMPLE I

To provide catalytic igniters of the present invention for evaluation, spark plugs were obtained which could be mounted in place of the standard glow plugs used in the Lister-Petter LPW-S2 two cylinder diesel chosen as the test engine. After removing the side ground electrode of the spark plugs a nickel rod electrode extension was welded to the center electrode of each plug for mounting of an alumina tube of 0.157 inch outer diameter and nominally 0.75 inches long and having spiral grooves about 0.010 inches deep, to serve as the heat sink mandrel. Thirteen turns (coils) of 0.020 inch diameter wire made of oxide dispersion processed 90% platinum-10% rhodium alloy (W. C. Heraeus Gmbh, DPH Pt-10Rh) was then wound in the grooves in the mandrel. Then, one end of the resulting coil was welded to the center nickel electrode and the other welded to the spark plug body in place of the original grounding electrode. In this embodiment, the electrode had a diameter of 0.064 inches with an electrical resistance at the operating temperature of the plug of approximately one percent of the wire. Operated at 5.5 volts in air the igniter plugs reached a temperature of about 1,478 degrees Kelvin. Cold cell testing of the Lister-Petter engine operating with Jet-A fuel showed the igniter plugs would start the engine at lower temperatures than the original equipment manufacturer (O.E.M.) glow plugs specified for the engine. At conditions at which either the O.E.M. glow plugs or the igniter plugs would start the engine, the igniter plugs of the present invention required less than half the electrical power required for the O.E.M. plugs. In the engine, only about ⅛ inch of the plug igniter tip extended into the engine prechamber. No modification of the engine hardware was required to install the igniter plugs. Igniter plugs of the present invention are readily made for any engine. Ungrounded plugs were made using commercially available multiple feed through Conax fittings in place of spark plug fittings to mount igniter coil/mandrel assemblies of the present invention. In this example, the electrical resistance of the electrode at the operation temperature of the igniter plug was approximately 25% of the wire.

EXAMPLE II

To evaluate the durability of igniter plugs of the present invention, after the tests of example I the igniter plugs were placed in another engine and run for over 200 hours and 27 start cycles using automotive diesel fuel. No change in electrical resistance was detected and cold cell testing of the aged igniter plugs showed no degradation in performance. To further evaluate high temperature durability, samples of the DPH platinum wire used in the igniter plugs of the present invention were heated in air to 1,573 degrees Kelvin for 100 hours to evaluate metal loss rate. Weight loss was only 1.7%.

Those skilled in the art will appreciate that many modifications of the preferred embodiment described above can be made without departing from the spirit and scope of the invention.

What is claimed is:

1. An igniter element comprising:

a) a heat sink mandrel, b) an oxidation resistant wire having two ends and a service temperature in excess of approximately 1400 degrees Kelvin wherein coiled around and in thermal contact with said heat sink mandrel, and c) an electrode having first and second ends, said electrode placed within said mandrel, said electrode having an electrical resistance less than said wire and an end of said wire is connected to an end of said electrode.

2. The igniter plug of claim 1 wherein said electrode has an electrical resistance less than about 25% of said wire.

3. The igniter plug of claim 1 wherein said heat sink mandrel has groves in the surface into which said wire is placed.

4. The igniter plug of claim 1 wherein the surface of said wire comprises an oxidation catalyst.

5. The igniter plug of claim 4 wherein said oxidation catalyst is comprised of a platinum group metal.

6. The igniter plug of claim 5 wherein said wire is comprised of a platinum metal clad tungsten.

7. The igniter plug of claim 4 wherein said wire is comprised of an oxide hardened platinum group metal.

8. The igniter plug of claim 7 wherein said wire is comprised of platinum.

9. The igniter plug of claim 7 wherein said wire is comprised of palladium.

10. The igniter plug of claim 7 wherein said wire is comprised of rhodium.

11. The igniter plug of claim 7 wherein said wire is comprised of iridium.

12. The igniter plug of claim 4 wherein said heat sink mandrel has groves in the surface into which said wire is placed.

13. The ignition plug of claim 1 wherein said mandrel comprises alumina.

14. An igniter plug for the ignition of fuel in admixture with air within a combustion chamber including a body with means for mounting said igniter plug in the combustion chamber wherein said body is capable of providing an electrical ground, and a first electrode which is sealed within said body to prevent the escape of the fuel/air mixture from the combustion chamber wherein said first electrode is electrically insulated from said body, the improvement comprising:

a) a second electrode which is an extension of said first electrode, b) a heat sink mandrel with grooves in the surface mounted around said second electrode, c) an oxidation resistant wire having a service temperature in excess of approximately 1400 degrees Kelvin wherein said wire is coiled around and in thermal contact with said heat sink mandrel wherein the first end of said wire is connected to the first end of said second electrode and the second end of said wire is attached to said body.

15. The igniter plug of claim 14 wherein the surface of said wire comprises an oxidation catalyst.

16. The igniter plug of claim 15 wherein the oxidation catalyst comprises a platinum group metal.

17. The igniter plug of claim 16 wherein said wire is comprised of an oxide hardened platinum group metal.

18. The igniter plug of claim 15 wherein said wire is comprised of platinum clad tungsten.

19. An igniter plug for the ignition of fuel in admixture with air within a combustion chamber including a body with means for mounting said igniter plug in the combustion chamber, a first electrode sealed within said body to prevent the escape of the fuel/air mixture from the combustion chamber wherein said first electrode is electrically insulated from said body, and a second electrode sealed within the body to prevent the escape of the fuel/air mixture from the combustion chamber wherein said second electrode is insulated from said first electrode and said body, the improvement comprising:

a) a third electrode which is an extension of said first electrode, b) a heat sink mandrel with grooves in the surface mounted around said third electrode, c) an oxidation resistant wire having a service temperature in excess of approximately 1400 degrees Kelvin wherein said wire is coiled around and in thermal contact with said heat sink mandrel wherein the first end of said wire is connected to the first end of said third electrode and the second end of said wire is connected to the first end of said second electrode.

20. The igniter plug claim 19 wherein the surface of said wire comprises an oxidation catalyst.

21. The assembly of claim 20 wherein the oxidation catalyst comprises a platinum group metal.

22. The assembly of claim 21 wherein said wire is comprised of oxide hardened platinum metal.

23. The assembly of claim 20 wherein said wire is comprised of a platinum group metal clad tungsten.

24. A method for combusting low cetane fuels in an internal combustion engine comprising:

a) passing an electrical current through a catalytic metal wire having a service temperature in excess of approximately 1400 degrees Kelvin, said wire coiled around and in thermal contact with a heat sink mandrel;

b) injecting fuel into admixture with air in a combustion chamber; and c) contacting said fuel with said wire; thereby heating the wire and igniting the fuel.

25. The method of claim 24 wherein said wire is comprised of an oxide hardened platinum group metal.

26. The method of claim 24 wherein said wire is comprised of a platinum group metal clad tungsten.

* * * * *